US005139190A

United States Patent [19]

Ferguson

[11] Patent Number: 5,139,190

[45] Date of Patent: Aug. 18, 1992

[54] DOCUMENT FEED TRACTOR WITH HEIGHT ADJUSTABLE WEB SUPPORT SURFACE

[75] Inventor: Gregory A. Ferguson, New Bedford, Mass.

[73] Assignee: Precision Handling Devices Inc., Fall River, Mass.

[21] Appl. No.: 689,417

[22] Filed: Apr. 22, 1991

[51] Int. Cl.[5] ..... B65H 20/20

[52] U.S. Cl. ..... 226/74; 400/616.1; 226/75; 226/86; 226/170

[58] Field of Search ..... 226/74, 75, 80, 81, 226/86, 52, 170; 400/616.1-616.3

[56] References Cited

U.S. PATENT DOCUMENTS

| | | | |
|---|---|---|---|
| 3,289,904 | 12/1966 | Foley | 226/74 |
| 3,507,431 | 4/1970 | Hepp et al. | 226/74 |
| 3,606,122 | 9/1971 | Brewster et al. | 226/74 |
| 4,453,660 | 6/1984 | Cornell et al. | 226/74 |
| 4,462,531 | 7/1984 | Seitz | 226/74 X |
| 4,611,737 | 9/1986 | Hubbard et al. | 226/74 |
| 4,707,158 | 11/1987 | Hofmann | 400/616.2 |
| 4,723,697 | 2/1988 | Tano et al. | 226/74 |
| 4,790,467 | 12/1988 | Rex et al. | 226/74 |
| 4,915,280 | 4/1990 | Howes et al. | 226/74 |
| 4,951,859 | 8/1990 | Gatto et al. | 226/74 |

*Primary Examiner*—Daniel P. Stodola
*Assistant Examiner*—Paul Bowen
*Attorney, Agent, or Firm*—Martin Lukacher

[57] ABSTRACT

A document feed tractor in which pins which drive the paper upon entry into perforations in margins of the paper along the edges thereof are connected to a belt on beams cantilever mounted thereto. A guide and support bar holds the beams and the pins down so that they travel along a linear path entering and leaving the perforations at opposite ends of the path. In order to drive the paper precisely, especially at high speeds where the belt and pins start and stop, without denting or ticking the paper and to maintain alignment of multi-part documents (without shingling), an adjustable shelf is located on the inside of the tractor so that the paper overlies the shelf. The elevation of the shelf with respect to the pins is selectively set in accordance with the thickness of the paper. The tractor can then be set so that the web is maintained at the center line or pitch line of the belt, thereby insuring precision feeding of the form even at high speeds with rapid accelerations and decelerations.

15 Claims, 7 Drawing Sheets

DOCUMENT FEED TRACTOR WITH HEIGHT ADJUSTABLE WEB SUPPORT SURFACE

The present invention relates to document feed tractors and more particularly to a document feed tractor for precise feeding of forms whether of single or multiple part documents (stacked piles of paper), at high speed with rapid acceleration and deceleration (stops and starts).

The invention is especially suitable for use in a tractor wherein the pins are cantilever mounted on beams which are attached to the tractor drive belt and extend over one edge of the belt so as to be clear of the belt when engaging the paper in driving relationship. In such tractors the areas of the pins which are intended to enter the perforations and drive the forms are disposed below the pitch line of the belt on which the pins are supported and from which they are driven; the pitch line being the center line of the belt or in cases of thin belts, the pitch line is taken to be along the exterior surface of the belt. The invention provides for the positioning of the form with respect to the pins so that forms, regardless of their thickness or number of plies, can be driven with minimal damage to the forms (denting or ticking the perforation edges) even when the forms are driven at high speed with rapid accelerations and decelerations.

It has been recognized that precise driving of paper in document feed (also known as pin-feed) tractors depends on the location of the paper with respect to the endless belt which drives the paper (the document) and that the paper is desirably located near the pitch line of the belt. Tractors have lids which are usually pivotally mounted on the tractor body in which the belt is driven and guided, and the lid of a tractor has been used to locate the web (the paper or document). See U.S. Pat. No. 4,611,737 issued Sep. 16, 1986 to J.D. Hubbard et al. It has also been proposed, in case of tractors with elastic belts, to stretch the belts using push-up bars. See U.S. Pat. No. 4,462,531 issued Jul. 31, 1984 and U.S. Pat. No. 3,289,904 issued Dec. 6, 1966, and U.S. Pat. No. 4,707,158 issued Nov. 17, 1987, where the belt is in an unstretched condition for paper loading and stretched so as to be tensioned during paper driving.

It has been discovered in accordance with the invention that precise high speed driving of webs (documents, paper, etc.) can be accomplished by precise location of the web with respect to the pins. It has been discovered in accordance with the invention that webs of different thickness are desirable located on different parts of the pin. Pins have a cylindrical collar at their base with tapered tips extending therefrom. It has been found that involute pin tip shapes are especially desirable, since such shapes enter and leave the perforations more cleanly than other shapes (such as hemispherical or conical tip shapes). The above-referenced Hubbard et al. patent demonstrates the advantages of involute shape pins.

For thicker webs, particularly multi-part forms, it is desirable that the webs be located on the cylindrical collar at the base of the pin. The driving forces are then distributed to all of the plies and they are retained in alignment by virtue of their location encompassing the collar, which is almost the same diameter as the perforations. Shingling of the various plies or parts of the web as might occur if the parts were drivingly engaged by the tip portion of the pins is thereby avoided. However, for thin webs, such as single and many double ply paper webs, sufficient driving force is applied by the tapered portion of the pin. When entering into driving engagement with the edge of the perforation, the tapered (involute) gradually applies the driving force and avoids denting or ticking of the perforation edges. Such denting or ticking causes vibration and imprecise driving, since the amount of denting or ticking is variable and can change from driving step to driving step; the drive forces usually being applied by stepper motors. Thus, in collating multi-part forms, it is desirable that the tractor drive with the cylindrical collar portion of the pin, while for thin forms it is desirable that the tractor drive the paper on the tapered, involute portion of the pin.

The invention provides a mechanism whereby the web can be adjustably positioned with respect to the pins so that the paper can be located at the pitch line of the belt and on the tip or cylindrical base portion depending upon the thickness of the web. The invention makes it possible to achieve accurate high speed driving (with rapid acceleration and deceleration) in a tractor of the type which has the pins cantilevered on beams from the endless drive belt. In such tractors the belt is held down so that the pins are essentially entirely below the pitch line of the belt and the web is maintained by the lid below the belt's pitch line. Such tractors may have belts in the form of interconnected links (much like a bicycle chain) or of essentially non-elastic material. The position of the cantilever beams is also set by a guide bar. The guide bar in a conventional cantilever beam tractor sets the height of the web with respect to the pin, since the lid is designed to hold the web down on the support surface of the guide bar. See U.S. Pat. Nos. 3,507,431 issued Apr. 21, 1970 and 3,606,122 issued Sep. 20, 1971.

Accordingly it is the principal object of the present invention to provide an improved web feed tractor wherein the web being driven can be adjustably and precisely located in height with respect to the pin and with respect to the pitch line of the belt of the tractor thereby providing for precision high speed feeding of the web.

It is another object of the present invention to provide an improved document feed tractor of the type having pins mounted on cantilevered beams which are attached to the endless belt of the tractor which has means for precisely locating the web with respect to the pins and the pitch line of the belt.

It is a further object of the present invention to provide an improved document feed tractor which enables webs of different thickness to be driven precisely at high speed and without damage to the web.

Briefly described, a tractor in accordance with the invention is adapted to feed a web having perforations spaced from each other by means of pins which enter the perforations and are connected to an endless belt mounted in a body which defines a path for the pins in the direction along which the web is fed. A plate which may provide a shelf is adjustably mounted on the body and presents a support surface for the web along the path of the pins. Means are provided for selectively positioning the plate to locate the web with respect to the height of the pins thereby enabling webs of different thickness to be located on different parts of the pins for precise high speed driving with high acceleration starting and stopping of the web without damage to the web.

The foregoing and other objects, features and advantages of the invention, as well as a presently preferred embodiment thereof will become more apparent from a reading of the following description in connection with the accompanying drawings in which.

Figure 1:
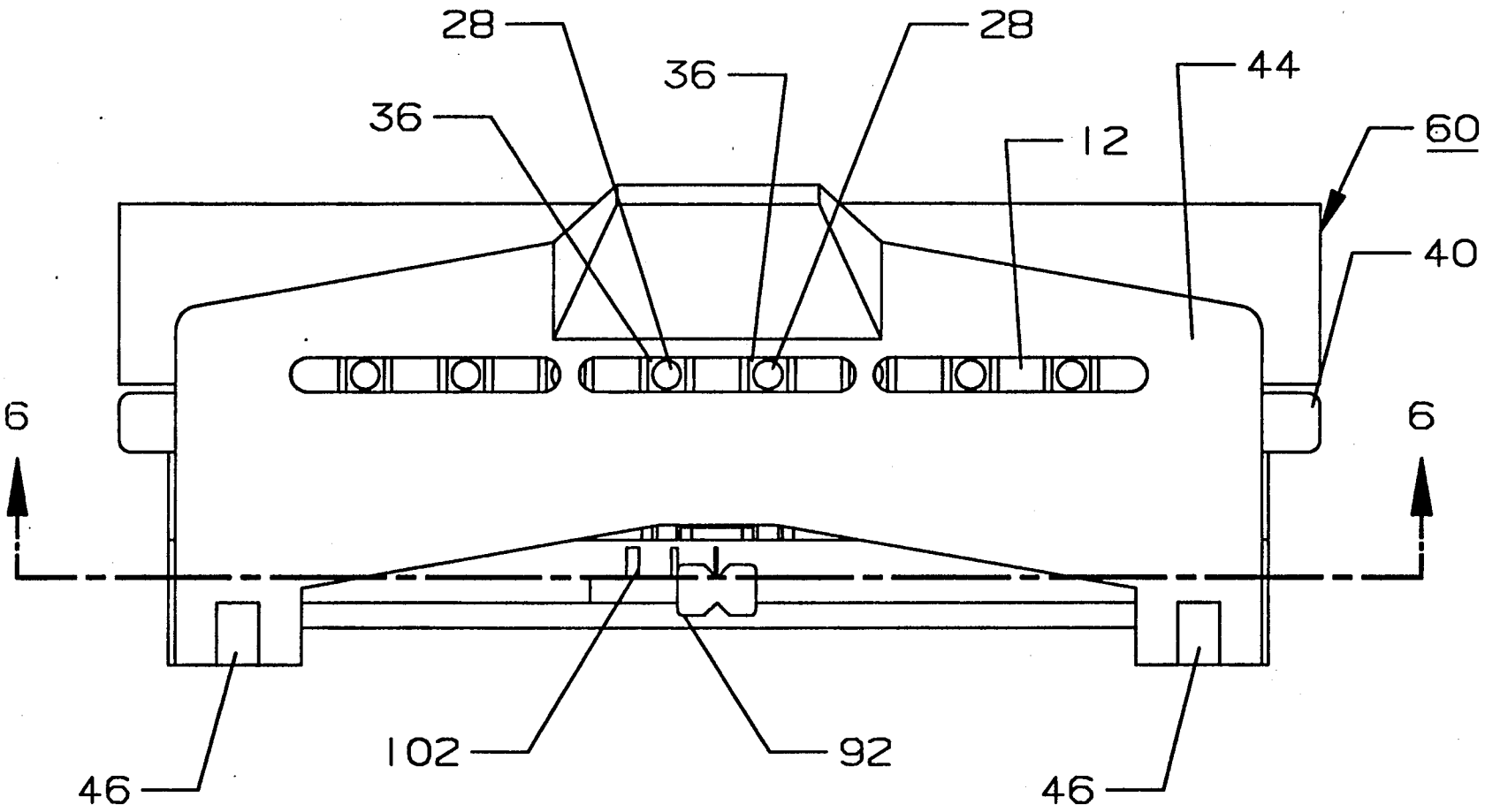
FIG. 1 is a top view of a document feed tractor embodying the invention.
Figure 5:
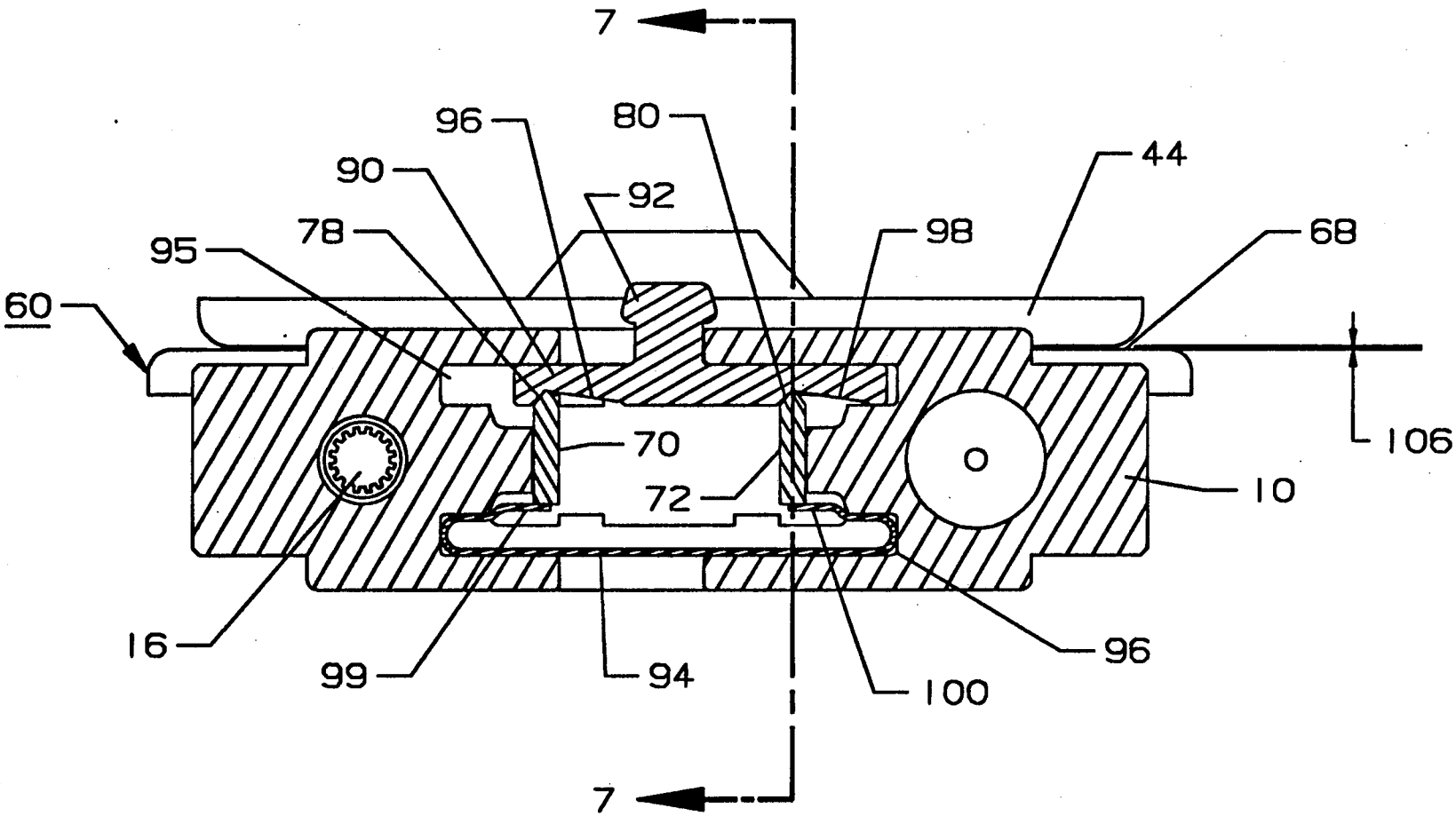
Figure 6:
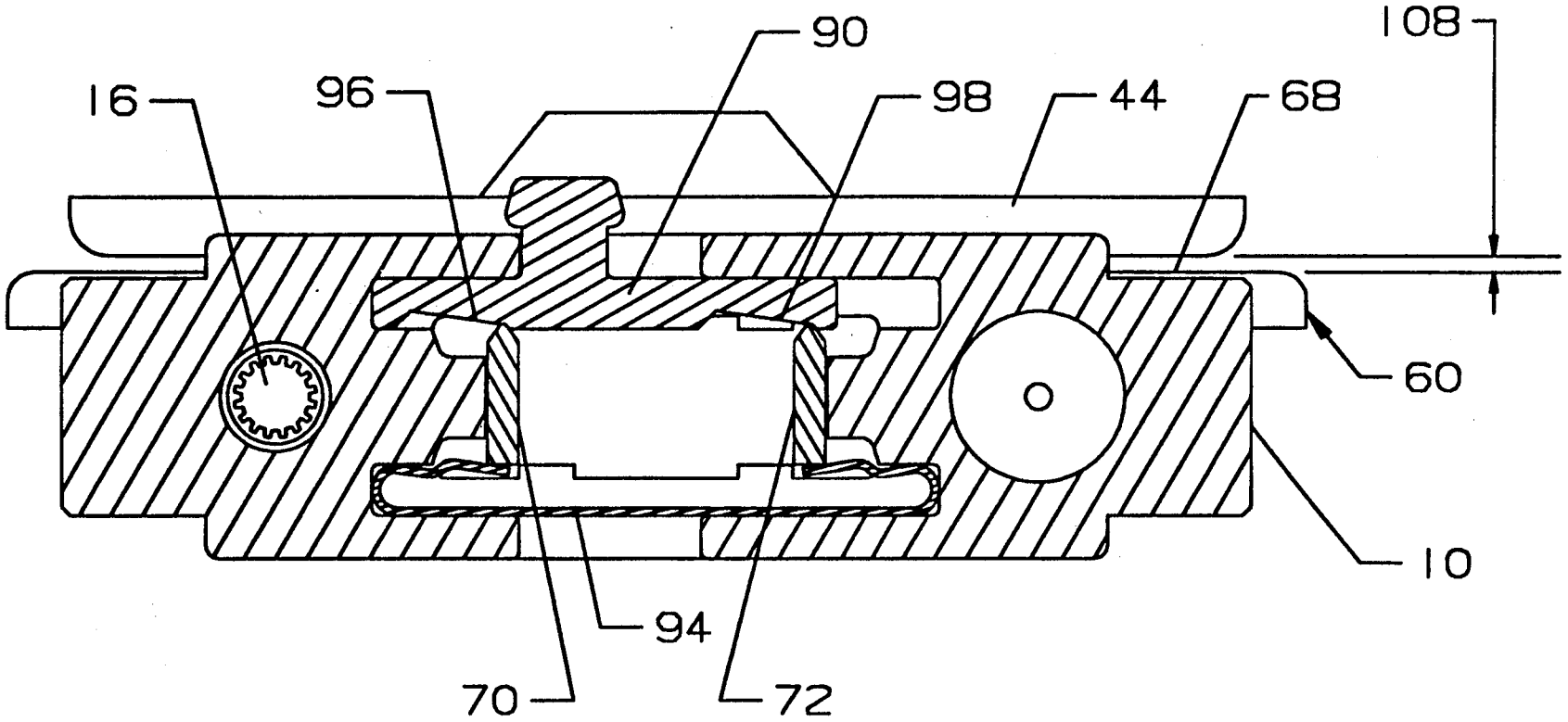
Figure 7:
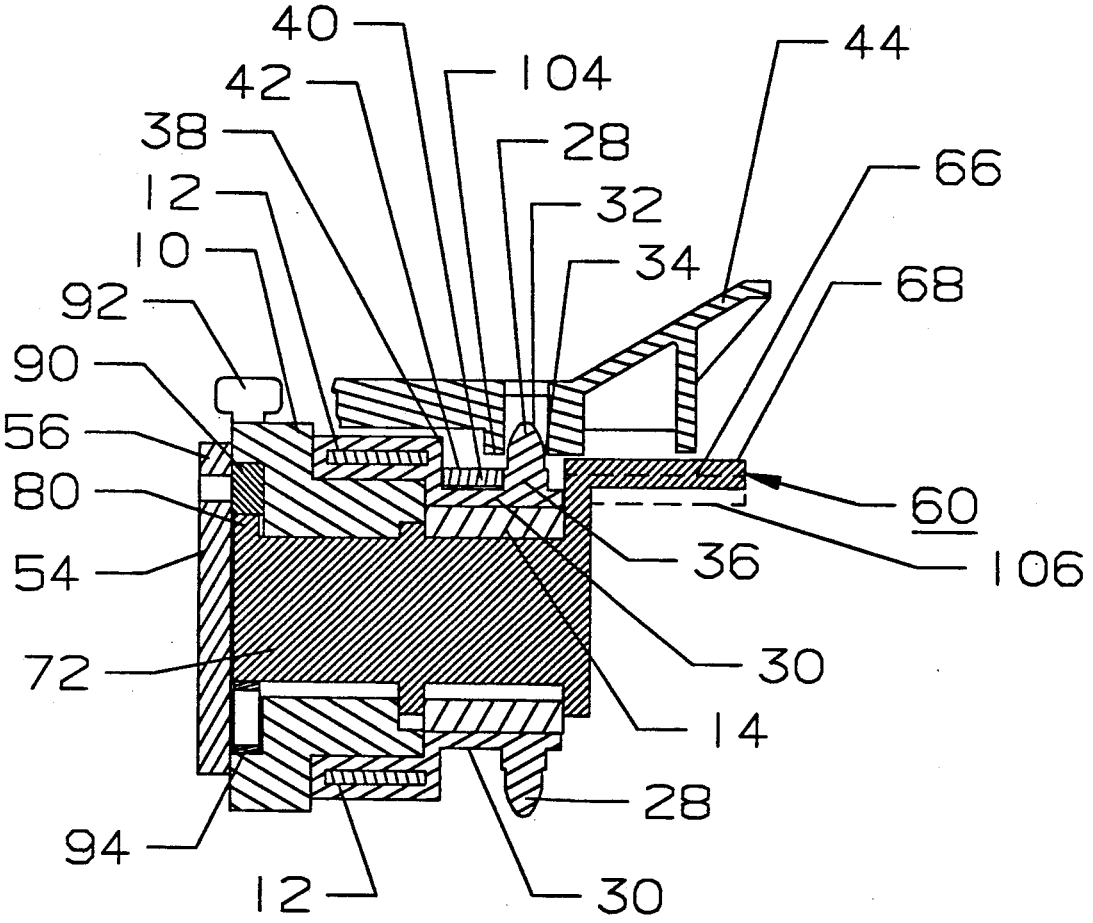

FIGS. 5 and 6 are similar sectional views taken along the line 6—6 in FIG. 1 with the mechanism for positioning the shelf of the tractor in its uppermost and lowermost position; and FIG. 7 is a sectional view taken along the line 7—7 in FIG. 5.

Referring to the drawings, there is shown a document feed tractor, which is one of a pair of tractors adapted to be mounted on a splined drive shaft and a support shaft, which are located along the marginal edges of a web, such as a continuous (e.g., fan folded) computer form in a printer or other document handling device. The tractor has a body or frame 10 in which an endless belt 12 is entrained around a block 14. The block receives a drive sprocket having a splined hole 16 and has a slot 18 in one wall of an opening 20 on the opposite end of the block from an opening 22. The opening 22 and a opening 24 in the block 10 journal the sprocket while the opening 20 and an opening 26 in the block journal an idler sprocket.

The belt 12 is made of essentially non-elastic material such as a polyamide (e.g., Kapton sold by the E.I. Dupont Company of Wilmington, Delaware). The belt carries pins 28 which may be integrally molded on the ends of beams 30 (see FIG. 7) which are cantilevered from the belt 12 as by being molded around the belt. Each of the pins has a tip 32 which is involute in cross section, a cylindrical base or collar 34 and a rectangular boss 36. The beams are generally Z-shaped in cross-section and ride on the block 14. The block 14 therefore provides a linear path for the pins where they can enter into and engage the perforations in the document to be driven.

Figure 4:
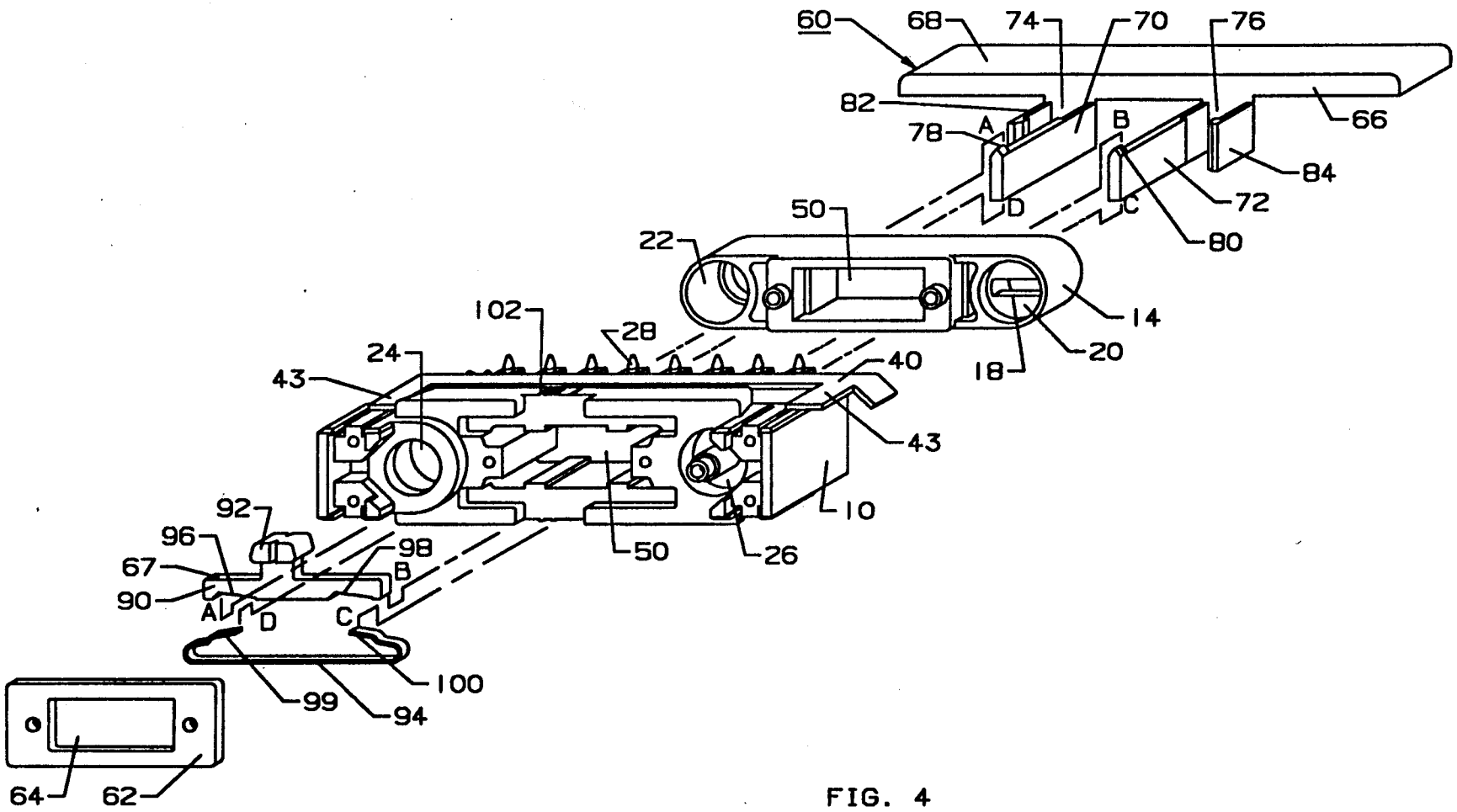
FIG. 4 is an exploded view of the body of the tractor which is shown in FIGS. 1 through 3.

This document is a paper sheet having an edge. The edge is stopped by a wall 38 of the beam structure 30. A guide bar 40 attached to the body 10 holds the beams 30 down on the block and presents a surface 42 to the document. The attachment is by legs 43 on the ends of the bar 40 to the frame 10, as shown in FIG. 4. This surface 42 is below the pitch line of the belt 12 as will be apparent from FIG. 7.

Referring to FIG. 1, the document is held down in a direction towards the surface 42 by a lid 44 which may be pivotally mounted on the body 10 by a mechanism 46 which is preferably of the type shown in U.S. Pat. No. 4,955,520 issued Sep. 11, 1990 to Gregory A. Ferguson.

Figure 2:
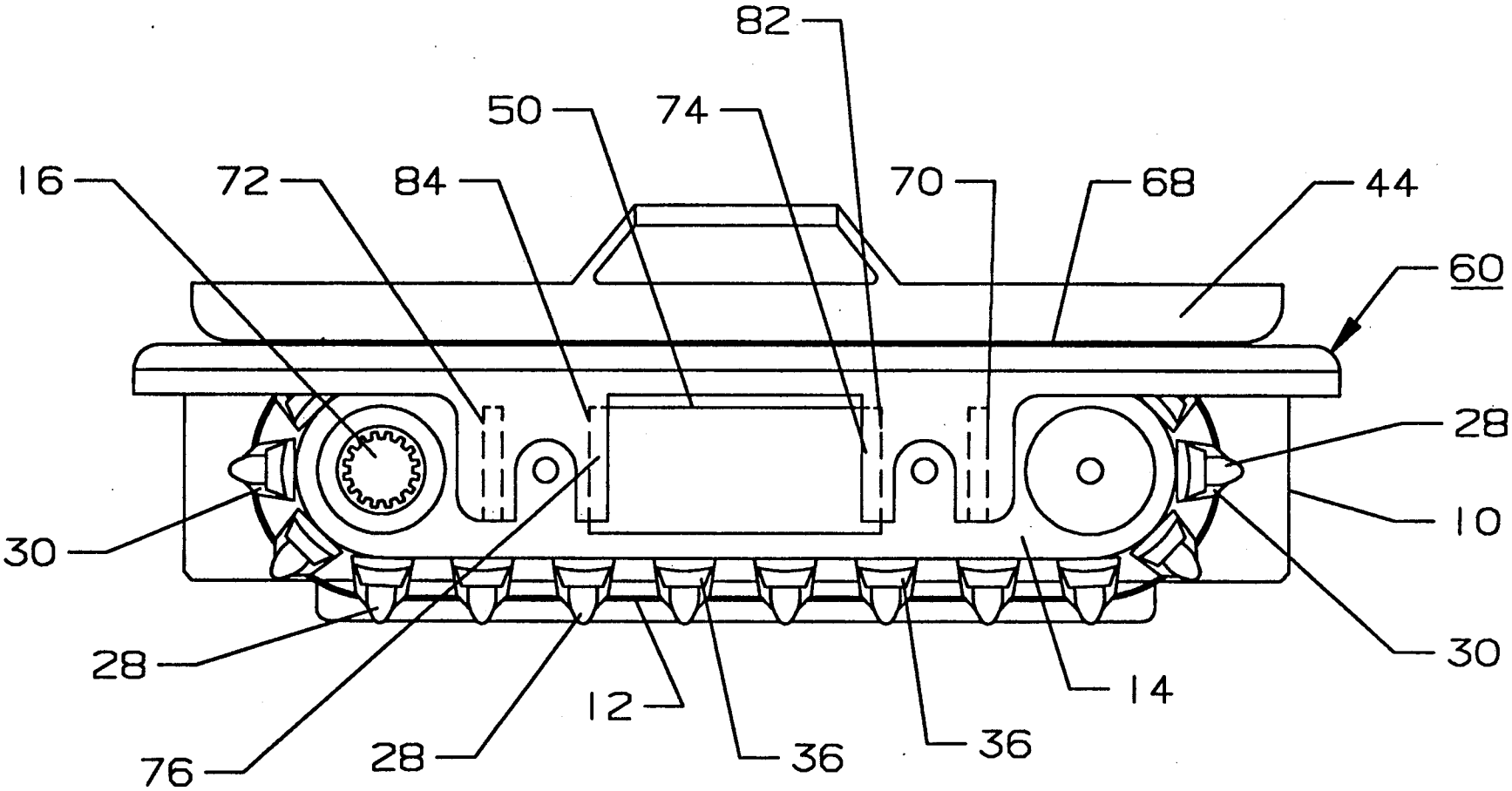
FIG. 2 is a front view from the inside of the tractor shown in FIG. 1.
Figure 3:
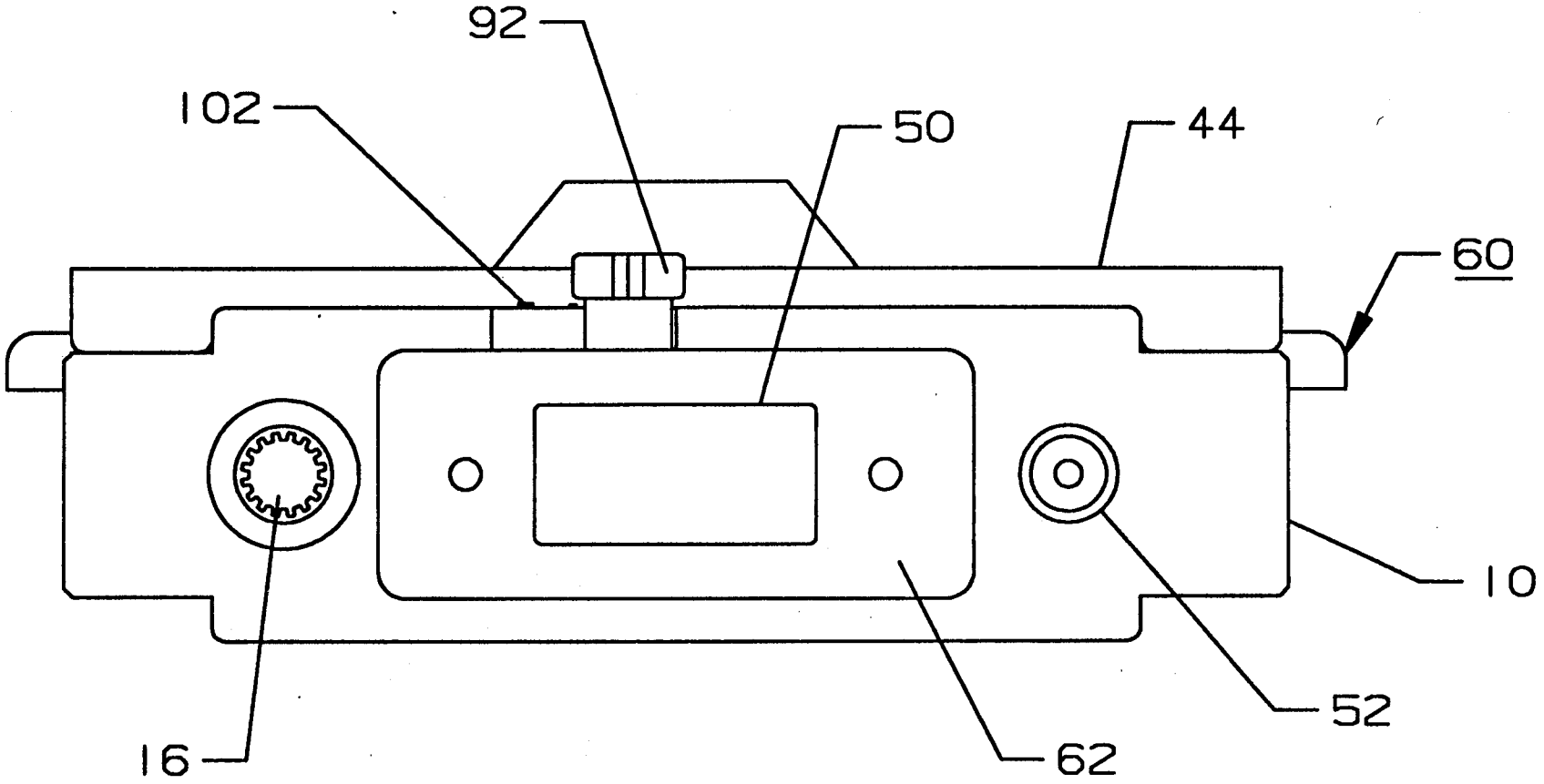
FIG. 3 is a front view from the outside of the tractor shown in FIGS. 1 and 2.

The belt tension may be adjusted by moving a shaft on which the idler sprocket is mounted, which shaft is not shown, but is contained in the opening 20 (FIG. 4) along the slot 18. The body 10 may be considered as an assembly when the block 14 is connected thereto. The inside of the body assembly as shown in FIG. 2 faces inwardly across the width of the document being fed. The outside of the tractor body is shown in FIG. 3.

It will be observed that there is a rectangular hole 50 extending through the body assembly from the inside to the outside thereof. In this hole there is a clamp mechanism (not shown) which clamps on the support shaft and is actuated between clamped and unclamped position by a control lever (not shown) which is mounted on the outside of the tractor body assembly 10 (on the idler sprocket shaft) journal 52 shown in FIG. 3. The mechanism may cam a plate 54 having a bar 56 which pinches the support shaft clamp. This plate 54 also captures a shelf 60 and its adjustment mechanism 67 in the body 10 of the tractor. The clamping mechanism is not shown in FIG. 4. In lieu of the clamping mechanism, a simple plate 62 having an opening 64, through which the support shaft clamp may extend, is shown. It will be appreciated that other types of support shaft clamps may be used utilizing the opening 50 which is provided in the body assembly of the body 10 and block 14.

The web height adjustment feature of the invention is provided by the shelf 60 and its adjusting mechanism 67. The shelf is a plate 66 which presents an upper surface 68. A pair of parallel arms 70 and 72 project from downwardly extending legs 74 and 76. Tips 78 and 80 project from the upper edges at the ends of these arms 70 and 72. Parallel to the arms 70 and 72 are guide arms 82 and 84 which ride in slots in the body 10 so that the surface 68 is maintained parallel to the path of the pins where they engage the web.

On the outside of the body there is located a slide 90 having an adjustment tab 92 (See FIG. 7). The slide 90 is captured in a slot 95 in the body 10 and has ramps 96 and 98 which are in engagement with the arms 70 and 72 at the projections 78 and 80. A leaf spring 94 is captured in a slot 94 in the body 10 and has ears 99 and 100 which engage the arms 70 and 72 and bias the shelf assembly 60 upwardly towards the web. The projections 78 and 80 are also biased against the ramps 96 and 98. By sliding the slide with the tab 92 to selected positions, denoted by indicia 102 which may be aligned with V notches in the tab 92, the height of the shelf and particularly the surface 68 thereof is selectively adjustable.

The end limits of the adjustment in the upward direction are shown in the solid line in FIG. 7. There the surface 68 may be spaced from the bottom surface 104 of the lid 44 by the narrowest lid gap. At this lid gap, which is indicated between the arrows 106 in FIG. 5, the web may be approximately at the pitch line of the belt 12 or about 10 mils (0.010 inch) therefrom. In the lowermost position as shown in FIG. 6 and by the dot dash lines 106 in FIG. 7, the lid gap is about 40 mils and the shelf surface 68 is lower and below the pitch line, as illustrated by the arrows 108 in FIG. 6. In the position shown in FIGS. 5 and 7, the surface 68 when projected through the pins 28 intersects the tips of the pins where they have involute shape. In the lowest position shown in FIG. 6 and by the dash lines 106, the surface 68 is in a plane which intersects the cylindrical collar 34 of the pins 28. The lower position is used when multi-part forms which may, for example, be 40 to 60 mils in thickness are to be fed. The upper position is used for single ply or double ply forms.

From the foregoing description it will be apparent that there has been described an improved document feed tractor, particularly a document feed tractor of the type where the pins are supported on cantilevered beams. The invention may be used in tractors of other design, for example where the pins are part of the belt. Other variations and modifications in the herein described tractor, within the scope of the invention, will undoubtedly suggest themselves to those skilled in the art. Accordingly, the foregoing description should be taken as illustrative and not in a limiting sense.

I claim:

1. In a tractor for feeding a web having perforations extending through said web between top and bottom surfaces thereof, said web perforations being spaced from each other by means of pins which enter the web perforations and are drivingly connected to and extend in height from an endless belt mounted on a body which defines a path for said pins in a direction along which said web is fed, the improvement comprising a plate presenting a support surface for the bottom of said web along the path of said pins, means (adjustably) mounting said plate on said body for movement of said plate in a direction along the height of the pins, and means for selectively positioning said plate to locate the height of said web along the height of (such) said pins thereby enabling webs of different thickness to be located on different parts of said pins.

2. The improvement according to claim 1 wherein said plate is a shelf which extends laterally away from said pins in a direction inwardly of said web.

3. The improvement according to claim 1 wherein said path is a linear path and said positioning means includes means for moving said plate perpendicularly to said path.

4. The improvement according to claim 3 wherein said plate surface is engagable with said web and said positioning means includes means for maintaining said surface parallel to said path.

5. The improvement according to claim 4 wherein said body has an inside and an outside and extends from the outside to the inside in the direction inwardly of said web, said plate defining a shelf (mounted) disposed on the inside of said body and carried by said mounting means, and said mounting means having actuating means (, including means connected to) for moving said shelf, said actuating means being disposed in said body and extending between the inside and the outside of said body, and said selectively positioning means being engageable with said actuating means for selectively positioning said surface at different (locations) heights with respect to said path along the height of said pins.

6. The improvement according to claim 5 wherein said actuating means comprises parallel arms projecting in a direction from the inside to the outside of said body, and said engagable means comprises cam means for moving said arms and thereby moving said shelf.

7. The improvement according to claim 6 wherein said cam means comprises a slide having ramps, each engagable with a different one of said arms, means biasing said arms towards said ramps, and guide means on the outside of said body capturing said slide for movement in the direction of said path of said web and capturing said shelf and said arms internally of said body for movement in a direction perpendicular to said path.

8. The improvement according to claim 1 wherein said pins have bases including cylindrical portions with tips tapering inwardly toward the axis of said cylindrical portions, means including beams extending laterally in the same direction beyond said belt for cantilever mounting said pins on said belt, a guide bar extending along said path between said belt and said pins and engagable with said pins and said beams for capturing said belt against movement in a direction laterally with respect to said path and in a direction perpendicular to said path, said guide bar presenting a surface to said web with respect to which said surface of said plate is movable in said direction perpendicular to said path.

9. The improvement according to claim 8 wherein said plate is a self on which said web is supported, said shelf and said guide bar being diametrically opposite to each other with respect to the axes of said pins with said surface of said guide bar and the surface of said shelf which supports said web in parallel relationship with each other.

10. The improvement according to claim 9 wherein said belt has a pitch line with a portion extending along said path, said guide bar's surface being below said pitch line, and said positioning means, including means for disposing said surface of said shelf in general alignment with said pitch line at one end limit of adjustment and below said pitch line at an end limit of adjustment opposite to said one end limit.

11. The apparatus according to claim 10 wherein the end limit opposite to said one end limit is approximately in alignment with said surface of said guide bar.

12. The improvement according to claim 11 wherein said surface of said shelf is in a plane which intersects said pin's tip portions when at said one end limit and is in a plane which intersects said pin's cylindrical portions when at the opposite end limit.

13. The improvement according to claim 12 wherein said tip portions are of involute shape in cross section.

14. The improvement according to claim 1 wherein said pins have cylindrical based portions and tip portions inwardly tapered from said base portions, said positioning means having upper and lower end limits wherein said support surface is approximately in alignment with said tip portions and said cylindrical portions, respectively.

15. The improvement according to claim 14 wherein said tip portions are involute in shape in cross sections.

* * * * *

UNITED STATES PATENT AND TRADEMARK OFFICE

CERTIFICATE OF CORRECTION

PATENT NO. : 5,139,190

DATED : August 18, 1992

INVENTOR(S) : Gregory A. Ferguson

It is certified that error appears in the above-identified patent and that said Letters Patent is hereby corrected as shown below:

Column 5, claim 1, line 13, cancel "(adjustably)" and line 17, cancel "(such)".

Signed and Sealed this

Thirty-first Day of August, 1993

Bruce Lehman

*Attest:*

BRUCE LEHMAN

*Attesting Officer*

*Commissioner of Patents and Trademarks*